US006875049B2

(12) United States Patent
Kyowski et al.

(10) Patent No.: US 6,875,049 B2
(45) Date of Patent: Apr. 5, 2005

(54) BATTERY CONNECTOR CAPABLE OF CONNECTING MULTIPLE POWER CONSUMING CIRCUIT BOARDS

(75) Inventors: Timothy H. Kyowski, Brantford (CA); Chao Chen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 10/719,455

(22) Filed: Nov. 21, 2003

(65) Prior Publication Data

US 2004/0161979 A1 Aug. 19, 2004

Related U.S. Application Data

(60) Provisional application No. 60/429,510, filed on Nov. 27, 2002.

(51) Int. Cl.[7] ..... H01R 3/00
(52) U.S. Cl. ..... 439/500; 439/862
(58) Field of Search ..... 439/500, 862, 439/65

(56) References Cited

U.S. PATENT DOCUMENTS 5,026,290 A * 6/1991 Dery ..... 439/65
5,551,883 A * 9/1996 Davis ..... 439/65
5,885,090 A * 3/1999 Comstock et al. ..... 439/65
5,909,102 A 6/1999 Stone, III et al.
6,077,130 A * 6/2000 Hughes et al. ..... 439/862
6,231,394 B1 * 5/2001 Schnell et al. ..... 439/630
6,302,727 B1 * 10/2001 Fedorjaka ..... 439/500
6,361,359 B1 * 3/2002 Du et al. ..... 439/500

FOREIGN PATENT DOCUMENTS

EP 0 939 457 A2 9/1999

* cited by examiner

*Primary Examiner*—Hae Moon Hyeon
(74) *Attorney, Agent, or Firm*—Jones Day; Krishna K. Pathiyal; Robert C. Liang

(57) ABSTRACT

An apparatus is provided for use in a device having a battery and one or more power consuming circuit boards that are powered by the battery. The battery connector includes one or more electrical conduits and a housing. Each electrical conduit includes a battery contact, a first circuit board contact, and as second circuit board contacts. The battery contact is for contacting the battery and forming an electrical connection therebetween. The first and second circuit board contacts are for contacting the one or more circuit boards and forming electrical connections therebetween. The housing retains the electrical conduits.

14 Claims, 8 Drawing Sheets

BATTERY CONNECTOR CAPABLE OF CONNECTING MULTIPLE POWER CONSUMING CIRCUIT BOARDS

CROSS-REFERENCE

This application claims the benefit of U.S. Provisional Application Ser. No. 60/429,510, filed on Nov. 27, 2002, the entire disclosure of which is incorporated herein by reference.

BACKGROUND

Currently, there are many battery powered electronic devices on the market for a wide range of applications. Such devices include, for example, wireless email devices, digital cameras, cellular telephones, and Personal Digital Assistants (PDA's). Such devices typically include a main circuit board for controlling the device's operations, and a battery for providing power to the circuit board. The battery is typically removable either for recharging or replacement.

Presently, some manufacturers have incorporated a secondary circuit board into their device, in effect splitting up control of the device onto two or more boards. The secondary circuit board may provide control for optional features that are available on the device for an added cost. Alternatively, the secondary circuit board may be a purchased board that is provided by an outside supplier that has particular expertise in a particular technology used in the device.

Typically, in a device having two boards, a first connector is provided on a first board for receiving power from the battery. A tracing on the first board leads from the first connector to a second connector, which connects the first board to the second board. Power is routed to the second board through this second connector.

SUMMARY

An apparatus for use in a device having a battery and one or more power consuming circuit boards comprises a plurality of electrical conduits and a housing. Each of the conduits has a battery contact, a first circuit board contact, and a second circuit board contact. The housing retains the plurality of conduits. Each of the electrical contacts on the electrical conduits mechanically mate with corresponding contacts on the battery and the one or more power consuming circuit boards to make electrical connections therebetween.

DETAILED DESCRIPTION

Figure 1:
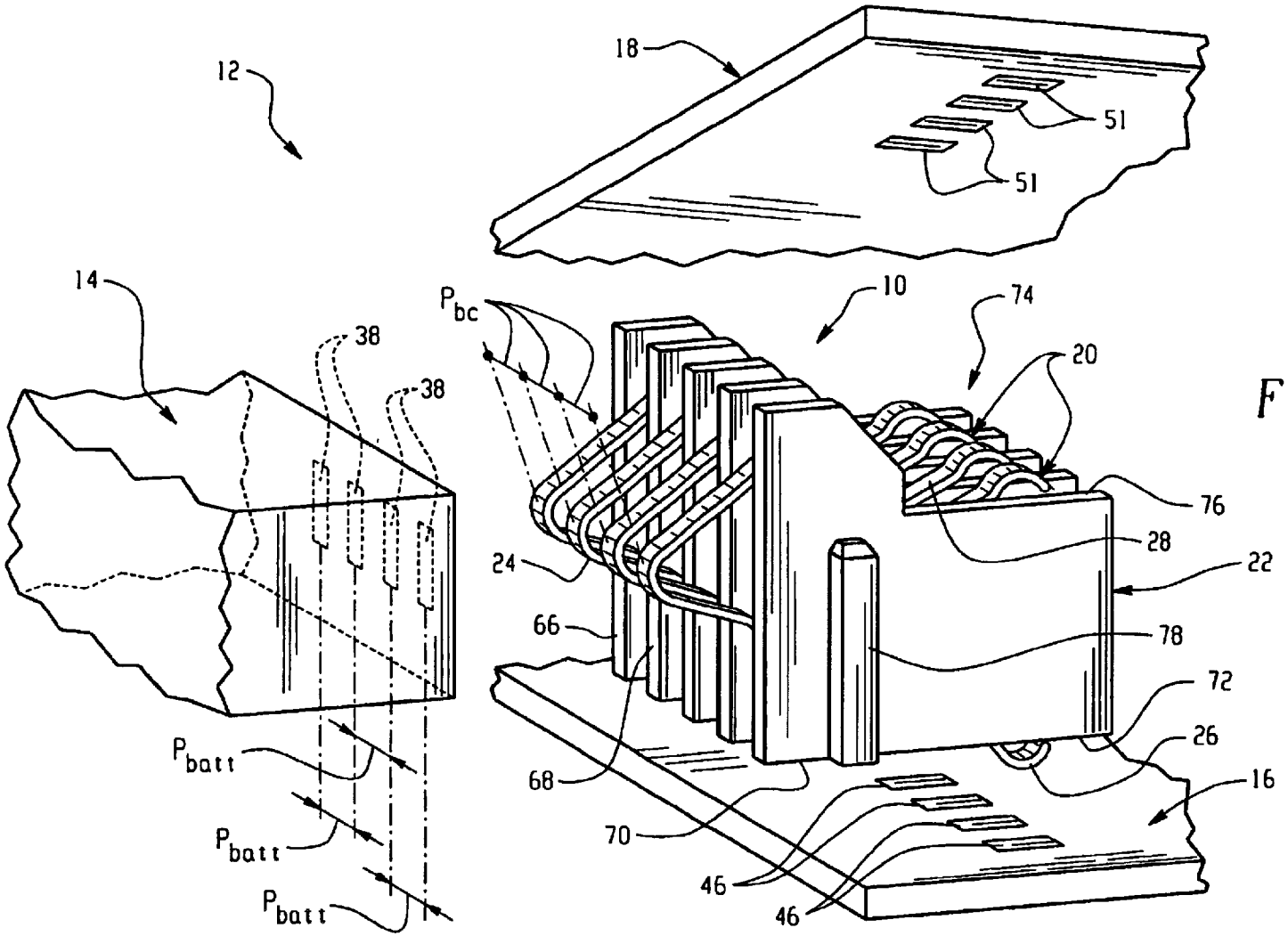
FIG. 1 is a perspective view of an exemplary battery connector.

The battery connector 10 shown in FIG. 1 includes a plurality of electrical conduits 20 and a housing 22. The battery connector 10 may include four electrical conduits 20 as shown in the figures, or any other suitable number of conduits depending on the particular configuration of the battery 14 and first and second circuit boards 16 and 18. The term "electrical conduit" in this application refers to a continuous, electrically conducting structure capable of passing an electrical signal.

Figure 2:
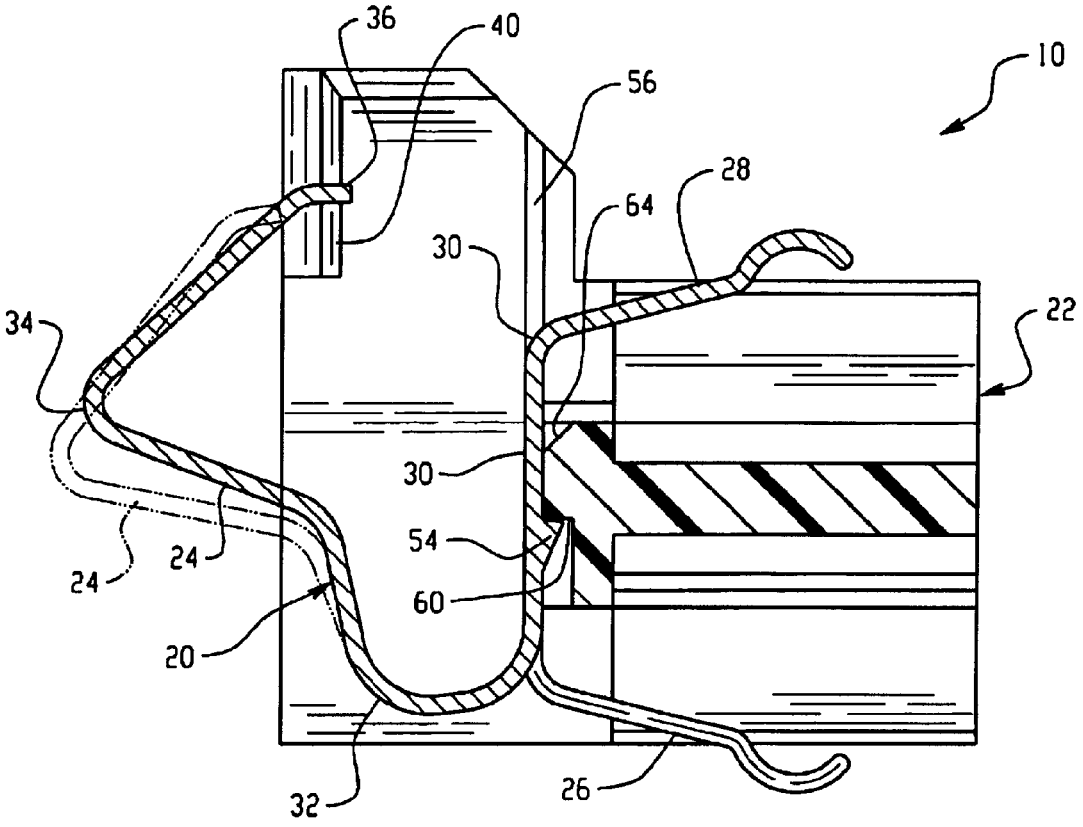
FIG. 2 is a sectional side view of the battery connector shown in FIG. 1.
Figure 3:
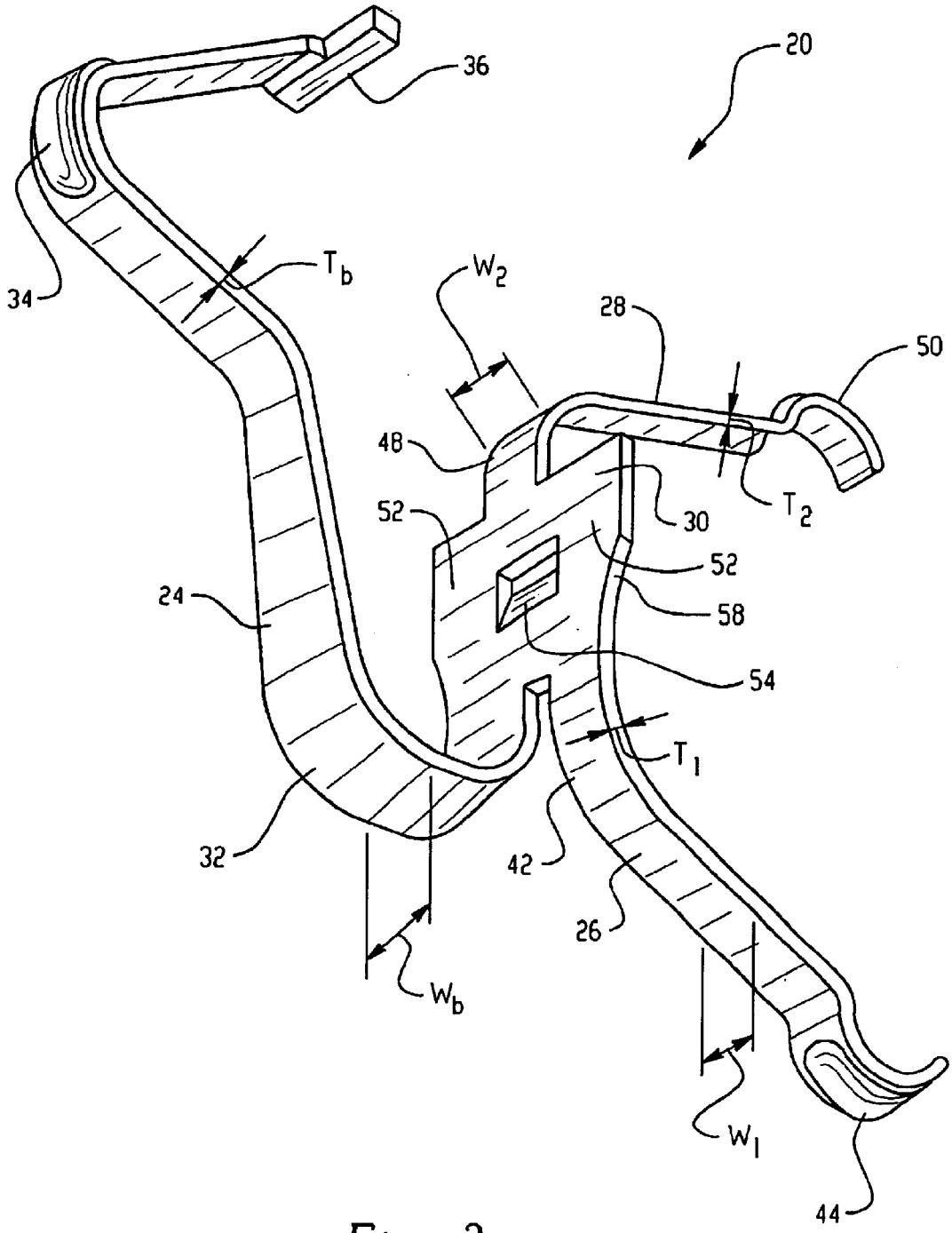
FIG. 3 is a perspective view of an electrical conduit that is part of the battery connector shown in FIG. 1.

Each electrical conduit 20 (as shown in greater detail in FIGS. 2 and 3) includes a battery contacting arm 24, a first board contacting arm 26, a second board contacting arm 28, and a base 30. Referring specifically to FIG. 3, the battery contacting arm 24 includes an optional spring 32, a battery contact 34, and an optional hook 36. When the battery 14 is installed in the device 12, the spring 32 applies a mechanical contacting force between the battery contact 34 and a corresponding connector contact 38 (FIG. 1) on the battery 14. The spring 32 may be a resilient, U-shaped portion of the battery contacting arm 24, located between the battery contact 34 and the base 30.

The battery contacting arm 24, and in particular the spring 32, may have a width $W_b$ and a thickness $T_b$, which permit the battery contacting arm 24 to be used for a selected number of battery replacements without failure due to fatigue. The number of battery replacements depends on the overall expected operating life of the device 12 as well as on other factors, such as the expected battery draw from the device and the storage capacity of the battery 14.

The battery contact 34 is the portion of the battery contacting arm 24 that mechanically mates with a corresponding contact on the battery 14 to make an electrical connection therebetween. The battery contact 34 may be a boss on the battery contacting arm 24, which has a generally domed surface. The domed surface provides a consistent contact area, even in cases where there is some misalignment in the battery contacting arm 24, either torsionally, angularly or linearly.

As explained above, the battery contacting arm 24 may contain a hook 36. The battery contacting arm 24 is shown in FIG. 2 in its rest position (dashed outline), prior to installation in the housing 22. In this rest position, the spring 32 is unflexed. When the electrical conduit 20 is mounted in the housing 22, the hook 36 engages a hook retaining piece 40 on the housing 22 to maintain the battery contacting arm 24 in a pre-engagement position, shown in solid outline in FIG. 2. The pre-engagement position of the arm 24 is the position of the arm 24 prior to engagement with the battery 14 (see FIG. 1). In the pre-engagement position, the spring 32 is flexed to some degree, and thus maintains the hook 36 in engagement with the hook retaining piece 40.

By hooking the arm 24 to the housing 22 and pre-loading the spring 32, the position of the battery contact 34 can be maintained with a greater degree of accuracy relative to a configuration in which there is no pre-load in the spring 32. This is because even if there is some manufacturing tolerance in the actual rest position of the arm 24, the arm 24 remains consistently positioned in the pre-engagement position. Any variance in the actual rest position of the arm 24 results in a greater or lesser degree of flex in the spring 32 when the arm is in the pre-engagement position. Providing a consistent positioning for the arm 24 in the pre-engagement position improves the alignment of one arm 24 with other arms 24 on other electrical conduits 20 on the battery connector 10. Consistent positioning allows for a greater assurance that the battery 14 and arms 24 engage when the battery 14 is installed in the device 12.

The pre-loading of the arms 24 also provides another advantage. During the operating life of the device 12, the battery 14 may be removed and re-installed many times, and as such, the battery contacting arms 24 may be subject to fatigue and the housing 22 may experience plastic deformation, whereby the rest positions of the electrical conduits may begin to creep. By having the arms 24 pre-loaded in the pre-engagement position, their pre-engagement position will not change due to fatigue or other factors that can affect their rest position.

When the battery contacting arm 24 is engaged by the battery 14, it may be flexed by any suitable amount. For example, the battery 14 may be positioned so that the contacts 38 abut the housing 22, so that in turn, the battery contacting arms 24 recede into the housing 22.

The first board contacting arm 26 may include an optional spring 42, as shown in FIG. 3, and includes a first board contact 44. The spring 42 may be a generally curved portion of the first board contacting arm 26, between the first board contact 44 and the base 30. The width and thickness of the spring 42 are shown at $W_1$ and $T_1$, respectively. The spring 42 may be subject to a relatively smaller number of cycles of flexure and release, relative to spring 32 of the battery contacting arm 24, because the battery connector 10 may remain installed in the device 12, in contact with the first and second boards 16 and 18 throughout most or all of the operating life of the device 12. Because of the relatively low number of expected cycles of flexure and release for the spring 42, one or both of the width $W_1$ and thickness $T_1$ may be selected to be smaller than the corresponding dimension of the battery contacting arm 24.

The first board contact 44 mechanically mates with a corresponding contact 46 (FIG. 1) on the first circuit board 16 to make an electrical connection therebetween, for the transmission of power from the battery 14 to the first circuit board 16. The first board contact 44 may be similar to the battery contact 34, and may be a generally domed surface on a boss on the first board contacting arm 26.

The second board contacting arm 28 may be similar to the first board contacting arm 26, and may include an optional spring 48 and includes a second board contact 50 for mechanically mating with a corresponding contact 51 on the second circuit board 18, which may be similar to the spring 42 and the first board contact 44, respectively. The spring 48 has a width $W_2$ and a thickness $T_2$.

The base 30 may serve as a mounting point for contacting arms 24, 26 and 28, and may include means for mounting the electrical conduit 20 to the housing 22. The mounting means may include wings 52 and a locking tab 54.

Figure 4A:
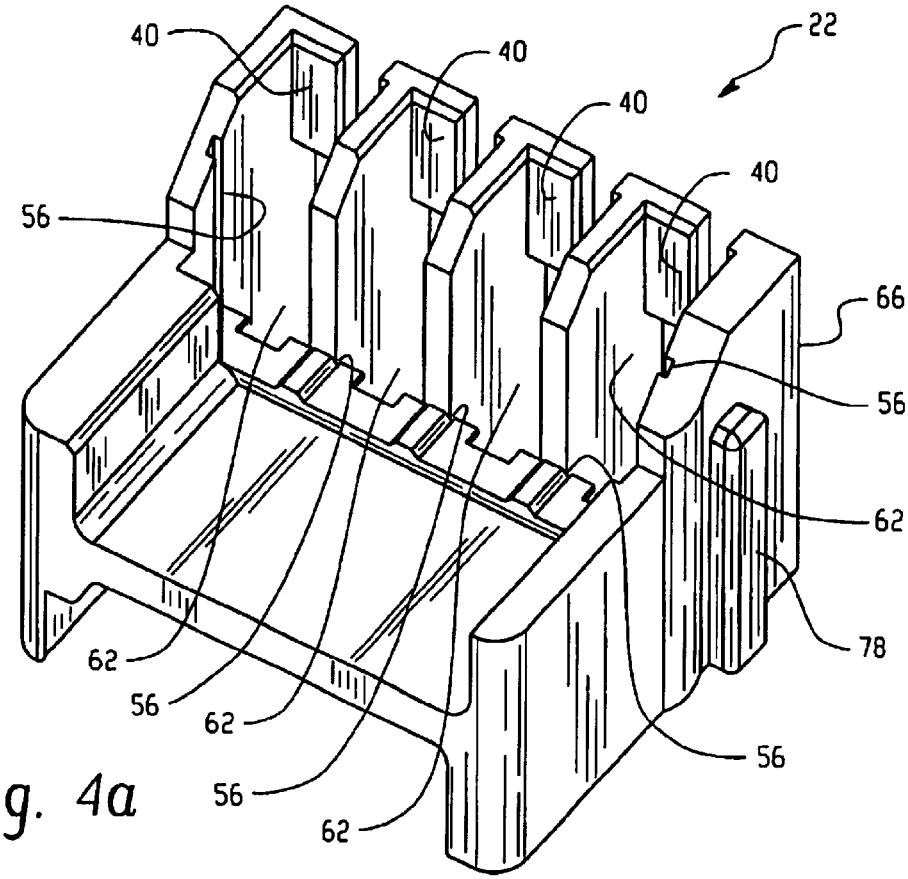
FIG. 4*a* is a perspective view of a housing that is part of the battery connector shown in FIG. 1.

The wings 52 engage corresponding blind slots 56 in the housing 22, as shown in FIG. 4*a*. The engagement of the wings 52 and the slots 56 assists in retaining the electrical conduits in the housing 22. A leading edge 58 of each wing 52 may be chamfered to facilitate the movement of the wings 52 in the slots 56 during the installation of the electrical conduits 20 in the housing 22.

When the electrical conduit 20 is installed in the housing 22, the locking tab 54 engages a corresponding locking shoulder 60 (FIG. 2) on the housing 22, to prevent the electrical conduit 20 from sliding backwards out of the slots 56, and thus, locks the electrical conduit 20 in place.

The electrical connector 20 is preferably made from a single piece of material to reduce any resistive losses in the electrical path from the battery 14 to each of the first and second circuit boards 16 and 18. It is alternatively possible, however, that the electrical conduit 20 may be made from two or more pieces of material that are physically joined in an electrically conducting manner. The material of the electrical conduit 20 is preferably relatively electrically conductive, and may be Beryllium-Copper, and may include an optional Nickel plating over the Beryllium-Copper. Gold plating may be laid over the nickel plating. Alternatively, other materials may be used for the electrical conduit 20.

The electrical conduit 20 may be manufactured from a sheet metal of a suitable thickness. The sheet metal may be stamped, and then the stamping may be bent as necessary, using any suitable means.

Figure 4B:
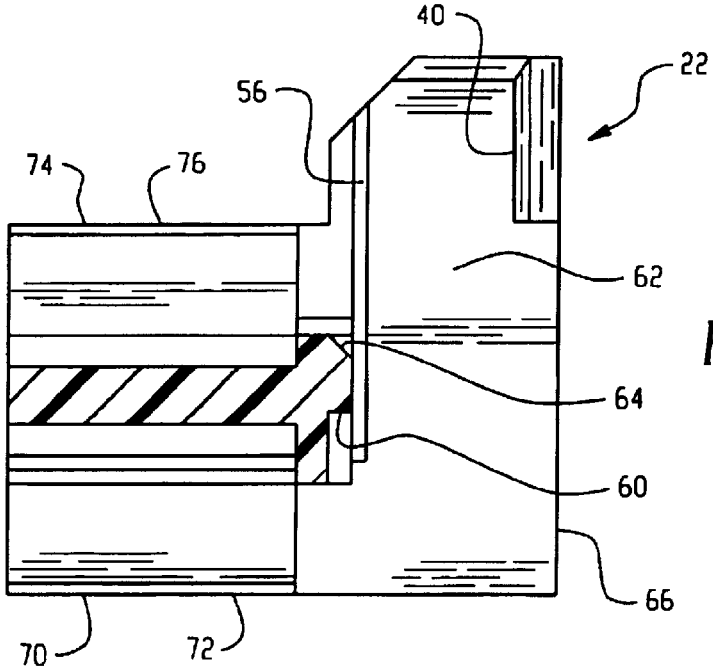
FIG. 4*b* is a sectional side view of the housing shown in FIG. 4*a*.

The housing 22, as shown in FIGS. 4*a* and 4*b*, defines a plurality of compartments 62, each of which receives and retains one of the electrical conduits 20. In the embodiment shown in FIG. 4*a*, there are four compartments 62. Each compartment 62 includes retaining means for retaining an electrical conduit 20. The retaining means may be any suitable retaining means. For example, the retaining means may include two blind slots 56 that slidably receive the wings 52 on the electrical conduit 20, as shown in FIG. 3. As shown in FIG. 4*b*, the retaining means may further include the locking shoulder 60, which engages the locking tab 54 on the electrical conduit 20.

A chamfered lead-in surface 64, as shown in FIG. 4*b*, may be provided on the housing 22 to move the locking tab 54 on the electrical conduit 20 into a non-engaging position, when the electrical conduit 20 is being moved towards the end of its travel in the blind slots 56. The lead-in surface 64 is shown as being relatively close to the locking shoulder 60 so that the lead-in surface 64 acts on the locking tab 54 almost immediately prior to the locking tab 54 moving into its engaged position against the shoulder 60. It is alternatively possible, however, for the lead-in surface 64 to be positioned anywhere to engage the locking tab 54 and move the locking tab 54 to its non-engaged position prior to its engagement with the locking shoulder 60.

Each compartment 62 may further include the optional hook retaining piece 40, for engaging the hook 36 on the battery contacting arm 24 of the electrical conduit 20.

Referring to FIG. 1, the housing 22 has a battery engagement face 66, from which the battery contacting arms 24 of the electrical conduit 20 may protrude. The housing 22 may include one or more battery engagement shoulders 68 on the battery engagement face 66, to abut the battery 14 and to limit the flexure of the battery contacting arm 24 when the battery 14 is installed.

The housing 22 includes a first board engagement face 70, from which the first board contacting arms 26 may protrude. The housing 22 may include one or more first board engagement shoulders 72, which abut the first circuit board 16 and which limit the flexure of the first board contacting arms 26.

In addition to the battery engagement face 66 and the first board engagement face 70, the housing 22 includes a second board engagement face 74, from which the second board contacting arms 28 may protrude. The housing 22 may include one or more second board engagement shoulders 76 which abut the second circuit board 18 and which limit the flexure of the second board contacting arms 28.

The housing 22 may further include a means for mounting the housing 22 to the first and second circuit boards 16 and 18. For example, the means may include a pair of mounting ribs 78, which may be received in corresponding slots that are either defined on one of the boards 16 or 18, or on a component, such as a structural casting, that is positionable between the boards 16 and 18.

It is alternatively possible for the housing 22 to mount to any other suitable component of the device 12 instead of mounting to the first and second circuit boards 16 and 18.

The housing 22 physically separates the electrical conduits 20 from each other, and also serves to isolate them electrically from each other. Thus, the housing 22 may be made from an electrically insulative material. For example, the housing 22 may be made from a glass-filled thermoplastic.

The electrical conduits 20 on the battery connector 10 have a center-to-center pitch $P_{bc}$. The contacts 38 on the battery 14 have a center-to-center pitch $P_{batt}$ that at least in part determines the center-to-center pitch $P_{bc}$. However, it may be advantageous for a number of reasons, for the center-to-center pitch $P_{bc}$ on the electrical conduits 20 to be large. A larger pitch $P_{bc}$ permits, for example, a large width $W_b$ of the spring 32 on the battery contacting arm 24, which, in turn, can improve the resistance of the arm 24 to fatigue. Furthermore, a larger pitch $P_{bc}$, permits the thickness of portions of the housing 22 to be larger, which permits the housing to have improved dimensional stability, and permits the housing to better insulate the electrical conduits 20 from each other.

Electrical conduits 20 may be optionally positioned on a center-to-center pitch $P_{bc}$ that is larger than the center-to-center pitch $P_{batt}$ of the battery 14. The degree of increase that can be accommodated in the pitch $P_{bc}$ over the pitch $P_{batt}$ depends at least in part on the width of the battery contacts 34, and the width of the contacts 38 on the battery 14. It will be noted, however, that for each successive electrical conduit 20, the offset between the center of the battery contact 34 and the center of the contact 38 on the battery 14 increases.

Making the width of the battery contact 34 relatively small, compared to the width of the contact 38 on the battery 14, increases the amount of offset that is permissible between the center of the battery contact 34 and the center of the contact 38 on the battery 14, which in turn, increases the permissible difference between the pitch $P_{bc}$ and the pitch $P_{batt}$.

Permitting the pitch $P_{bc}$ of the electrical conduits 20 to be different than the pitch $P_{batt}$ of the contacts 38 on the battery 20 creates flexibility in battery choice. A different $P_{bc}$ pitch enables the battery connector 10 to be used with batteries 14 having different pitches $P_{batt}$ of contacts 38. Furthermore, as described above, a larger pitch $P_{bc}$ for the electrical conduits 20 relative to the pitch $P_{batt}$ allows the springs 32 on the battery contacting arms 24 to be wider, increasing the resistance to fatigue for the springs 32.

Figure 5A:
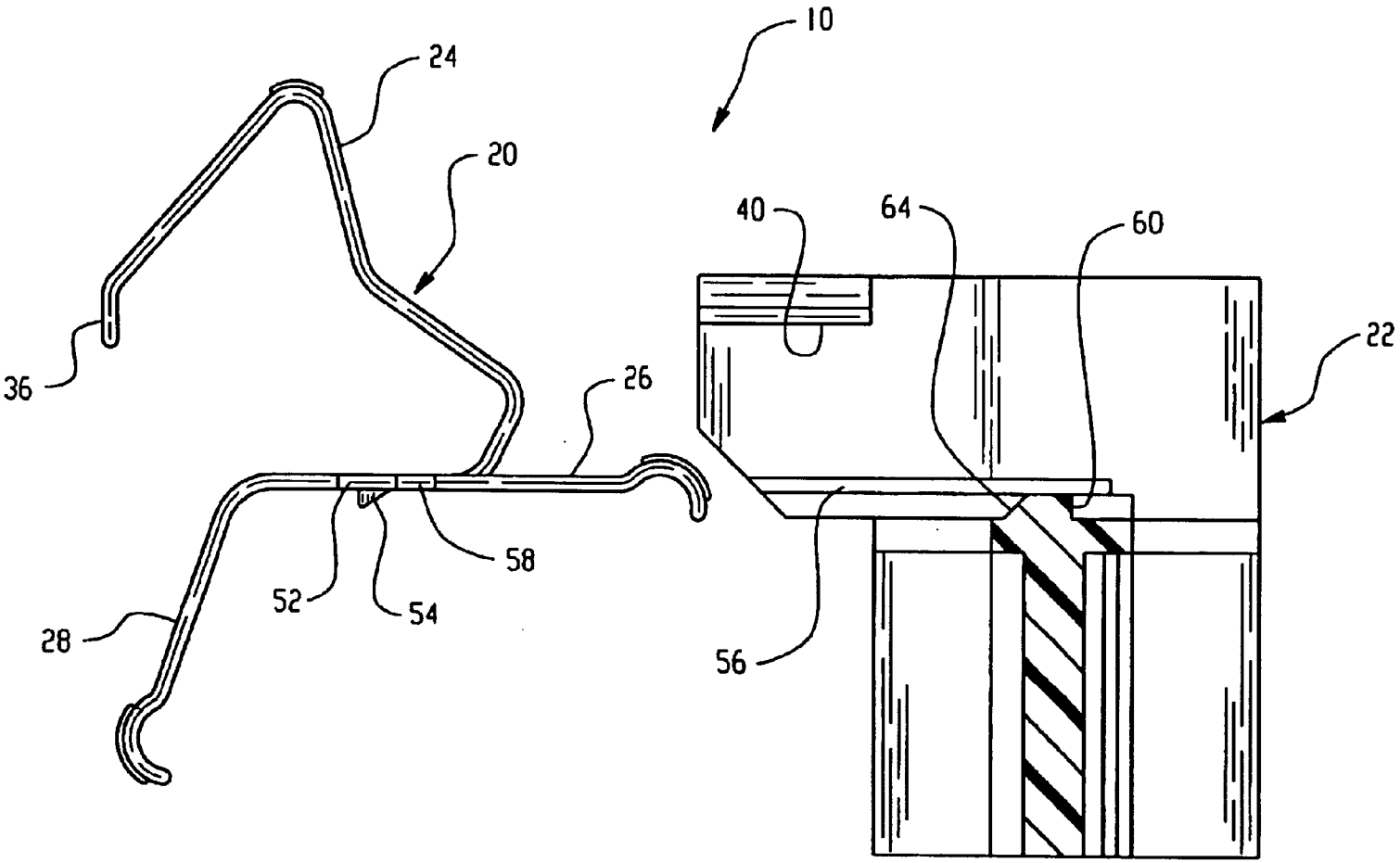
FIGS. 5*a*, 5*b*, 5*c*, 5*d* and 5*e* are sectional side views that illustrate the assembly of the battery connector shown in FIG. 1.

Reference is made to FIGS. 5*a,* 5*b,* 5*c,* 5*d* and 5*e,* which illustrate the assembly process for the electrical conduits 20 and the housing 22. Initially, prior to installation of the electrical conduits 20 in the housing 22, the first board contacting arm 26 on each electrical conduit 20 may extend outwards, generally parallel to the base 30, as shown in FIG. 5*a*. Also initially, the battery contacting arm 24 is in the rest position.

Figure 5B:
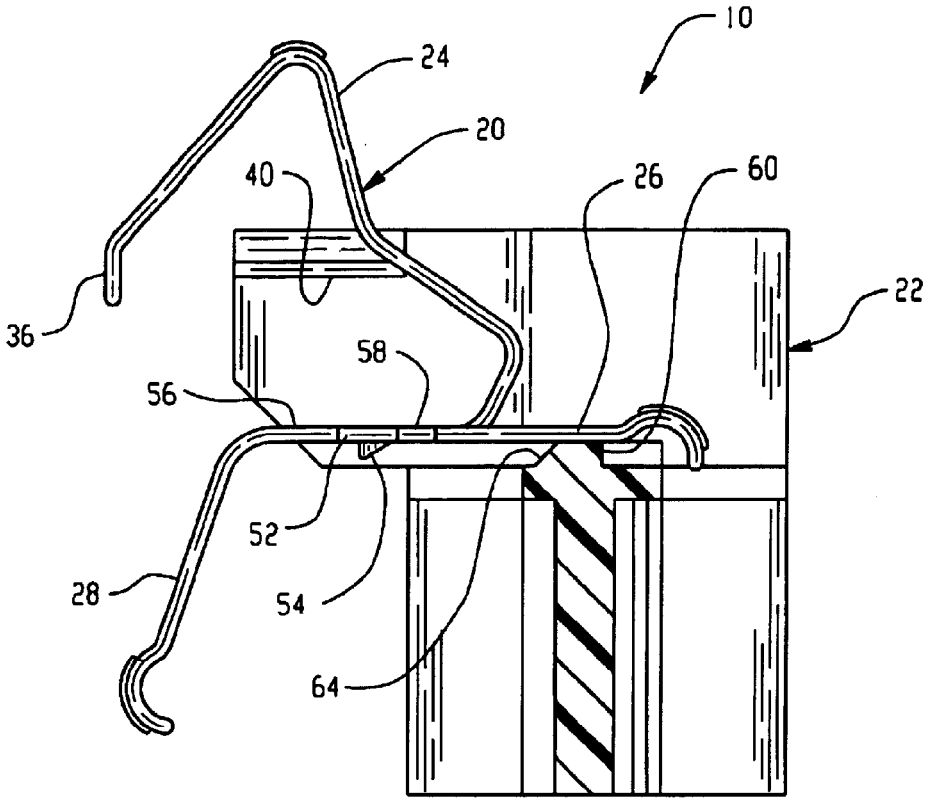

The electrical conduits 20 may be installed in the housing 22 by sliding engagement of the wings 52 in the slots 56, as shown in FIG. 5*b*. Also shown in FIG. 5*b*, the battery contacting arm 24 is flexed at least to the pre-engagement position and preferably therepast, so that, as the electrical conduit 20 is moved along in the slots 56, the hook 36 can be positioned to engage the retaining piece 40 on the housing 22.

Figure 5C:
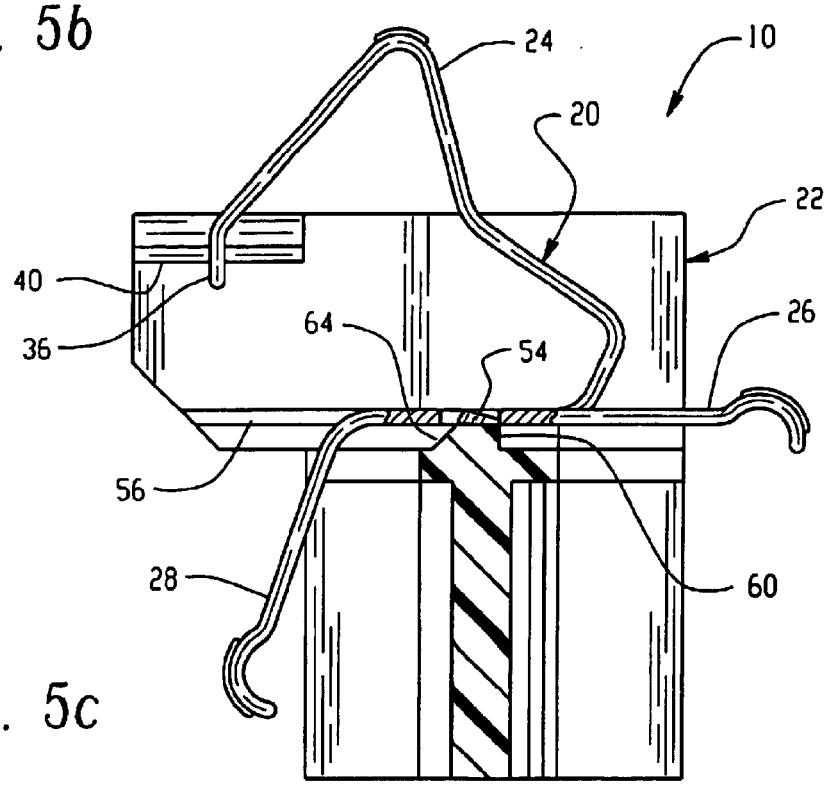

At some point during the movement of each of the electrical conduits 20 in the slots 56, the locking tab 54 is moved into a non-engaged position by the lead-in surface 64, as shown in FIG. 5*c*. Also shown in FIG. 5*c* is that as the electrical conduit 20 is moved along in the slots 56, the hook 36 is engaged by the hook retaining piece 40.

Figure 5D:
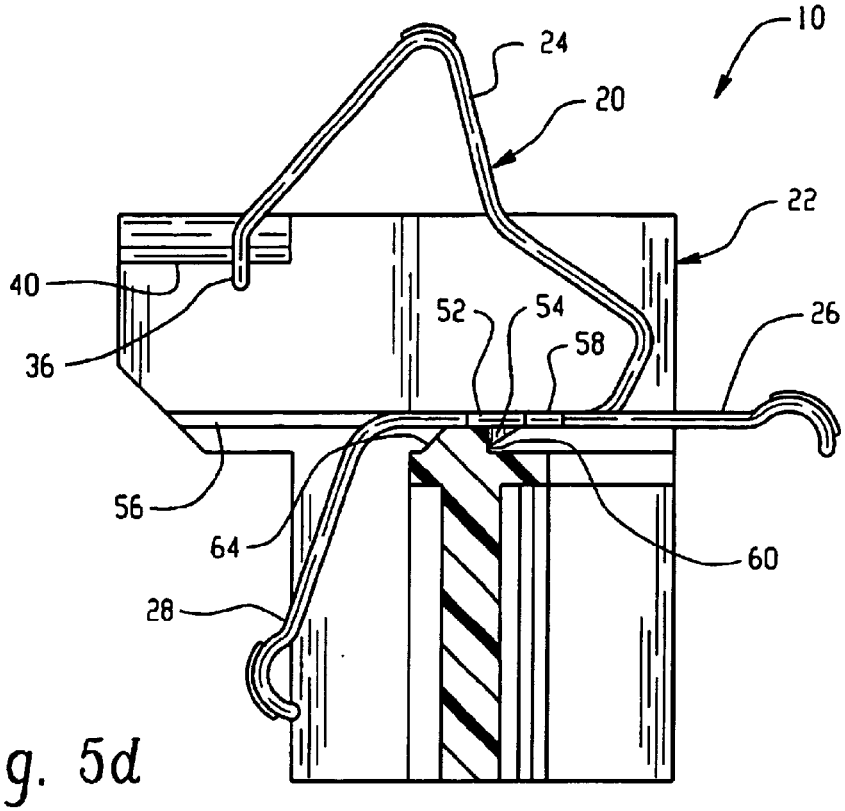

When the wings 52 reach the blind end of the slots 56, the locking tab 54 has moved past the locking shoulder 60, and has moved into the engagement position to engage the locking shoulder 60, as shown in FIG. 5*d*.

Figure 5E:
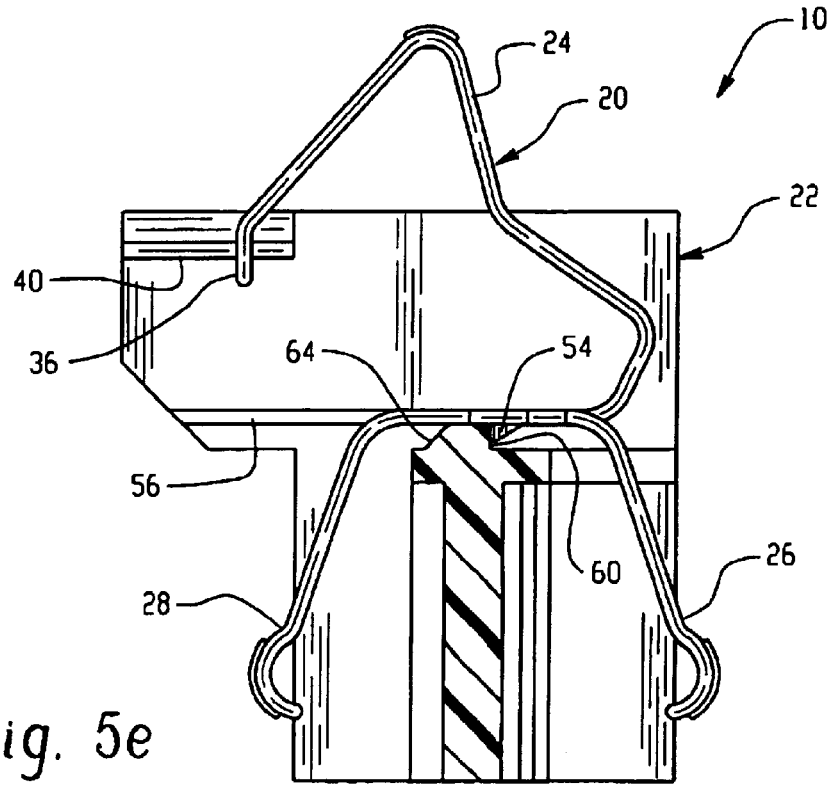

During the passage of the first board contacting arm 26 through the housing 22, the arm 26 may be bent by any suitable means so that it achieves the position shown in FIG. 5*e*, wherein it is ready for engagement with the first circuit board 16. Once the battery connector 10 is in the configuration shown in FIG. 5*e*, the assembly is complete.

Figure 6:
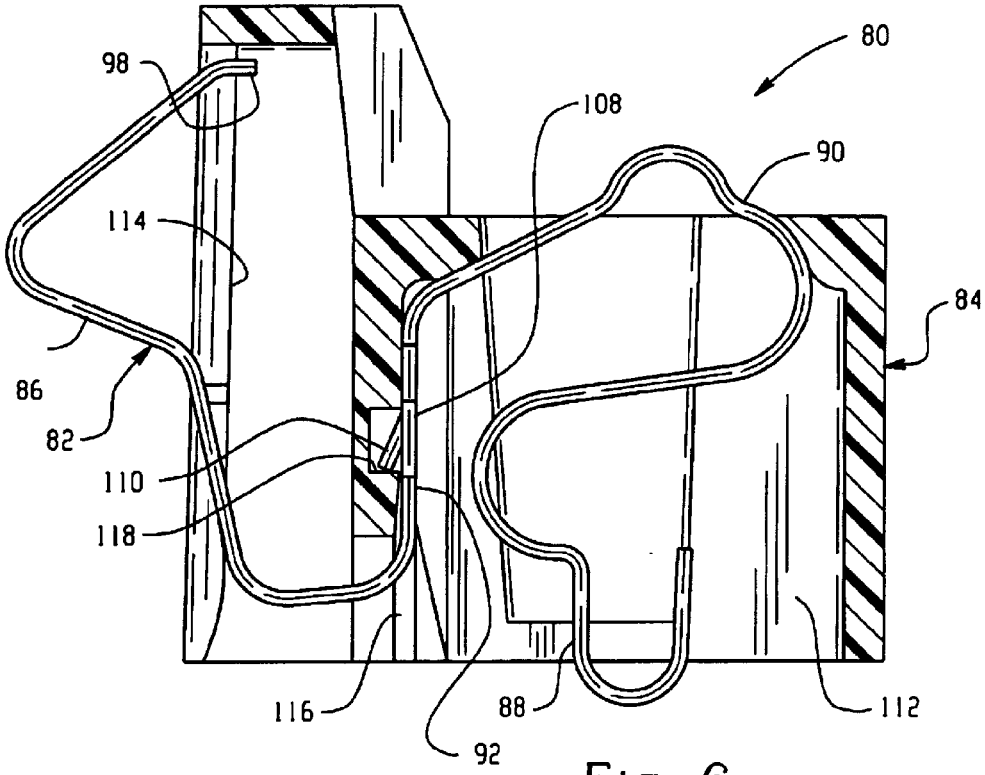
FIG. 6 is a sectional side view of another exemplary battery connector.
Figure 7:
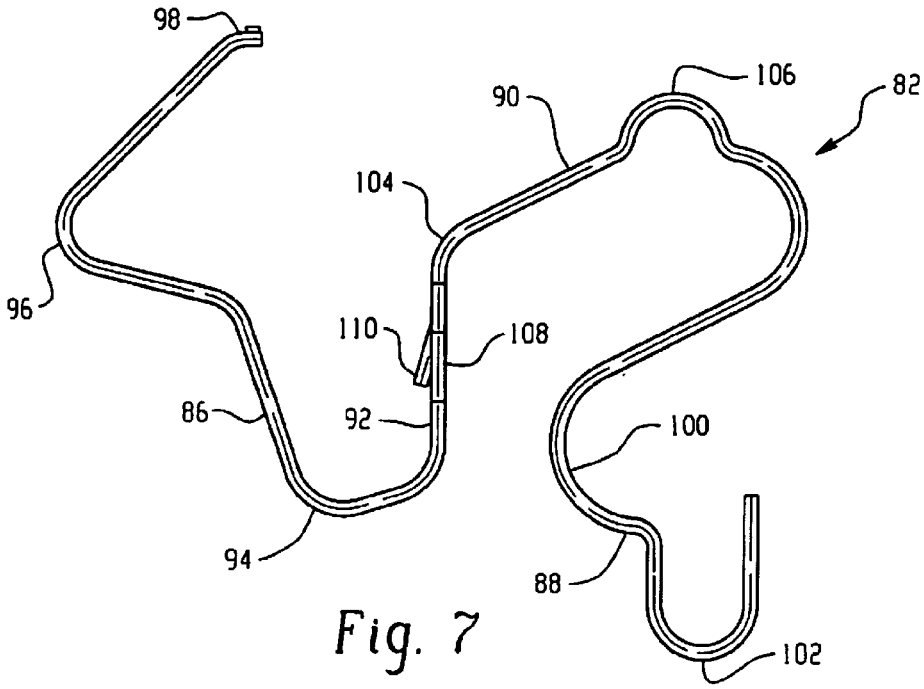
FIG. 7 is a side view of an electrical conduit that is part of the battery connector shown in FIG. 6.

Reference is made to FIG. 6, which shows another example battery connector 80. The battery connector 80 may be similar to the battery connector 10 (FIG. 1), and includes a plurality of electrical conduits 82 and a housing 84. Referring to FIG. 7, the electrical conduits 82 may be similar to the electrical conduits 20 (FIG. 1) and each includes a battery contacting arm 86, a first board contacting arm 88, a second board contacting arm 90 and an optional base 92. The battery contacting arm 86 may be similar to the battery contacting arm 24 (FIG. 3), and may include an optional spring 94, a battery contact 96 and an optional hook 98.

The first board contacting arm 88 may be similar to the first board contacting arm 26 (FIG. 3), except that the first board contacting arm 88 is connected to the end of the second board contacting arm 90. The first board contacting arm 88 may include an optional spring 100 and has a first board contact 102. The spring 100 permits the first board contacting arm 88 to move relative to the second board contacting arm 90, and permits the exertion of a mechanical contact force between the first board contact 102 and the contact 46 on the first circuit board 16, as shown in FIG. 1. The spring 100 may be positioned between the first board contact 102 and the end of the second board contacting arm 90.

The second board contacting arm 90 may be similar to the second board contacting arm 28, as shown in FIG. 3, and may include a spring 104 and has a second board contact 106. The spring 104 may be positioned between the second board contact 106 and the base 92 and permits the movement of the second board contact 106 relative to the base 92. The spring 104 also permits the exertion of a mechanical contacting force between the second board contact 106 and the contact 51 on the second circuit board 18, as shown in FIG. 1.

The base 92 may be similar to the base 30, and may include wings 108 and a locking tab 110, which may be similar to the wings 52 and the locking tab 54 respectively, as shown in FIG. 3.

The housing 84 may be similar to the housing 22 and may define a plurality of compartments 112, each of which retains an electrical conduit 82. Each compartment 112 may include a retaining piece 114 for engaging and retaining the hook 98, to retain the battery contacting arm 86 in the pre-engagement position. Each compartment 112 may further include two slots 116 and a locking shoulder 118 which may be similar to the slots 56 and the locking shoulder 60, as shown in FIG. 4*b*.

By providing the electrical conduit 82 with the configuration shown in FIGS. 6 and 7, the width of the battery contacting arm 86 may be increased, relative to the battery contacting arm 24, shown in FIG. 3, while providing the electrical conduit 82 with a similar overall width as the electrical conduit 20. This permits the battery contacting arm 86 to be more resistant to fatigue than the arm 24 of the electrical conduit 20 shown in FIG. 3.

It is alternatively possible for the electrical conduits 20 and 82 to not include a base 30 or 92, and instead to have arms that connect to each other directly. In this alternative, the means for mounting the electrical conduit 20 or 82 to the housing 22 or 84, may be positioned directly on one or more of the arms.

The arms on the electrical conduits 20 and 82 have been described as having springs integrally formed thereon. It is optionally possible for the arms to incorporate separate springs that are not integrally formed thereon, which are connected between the contacts and the base 30 or 92.

Alternatively, it is possible for any or all of the arms to not include springs. The arms may be relatively fixed in position for contacting the battery 14 and the first and second circuit boards 16 and 18 (FIG. 1). As a further alternative, the battery contacts and the first and second board contacts may be positioned on a structure other than the arms that have been described above. For example, the contacts may be positioned directly on a plate. The contacts may be bosses on the plate and may have the battery 14 and the first and second circuit boards 16 and 18 abutted thereagainst to form an electrical connection.

It is alternatively possible for one or both of the first and second board contacting arms 26 and 28, or 88 and 90 to be physically joined, for example, by soldering or welding, to the first or second circuit boards 16 and 18.

What is claimed is:

1. An apparatus for use in a device having a battery and one or more power consuming circuit boards, comprising:

a plurality of electrical conduits, each of the electrical conduits having a battery contact located on a battery contacting arm, a first circuit board contact located on a first circuit board contacting arm, and a second circuit board contact located on a second circuit board contacting arm;

a housing that retains the conduits; and a spring integrally formed in or connected to the battery contacting arm, the spring being configured to apply a mechanical contacting force between the battery contact and a corresponding contact on the battery, and the spring being flexed when the battery contacting arm is in both the pre-engaged and engaged positions, wherein the contacts on the electrical conduits mechanically mate with corresponding contacts on the battery and the one or more power consuming circuit boards to make electrical connections therebetween, and the battery contacting arm and spring are movable between a pre-engaged position when the battery contacting arm is not in contact with the battery and an engaged position when the battery contacting arm is in contact with the battery.

2. The apparatus of in claim 1, wherein each electrical conduit is formed by a single piece of material.

3. The apparatus of claim 1, wherein the battery contact includes a boss.

4. The apparatus of claim 1, wherein the first or second circuit board contacts includes a boss.

5. The apparatus of claim 1, wherein the housing physically separates the plurality of electrical conduits.

6. The apparatus of claim 1, wherein the housing electrically isolates the plurality of electrical conduits from each other.

7. The apparatus of claim 1, wherein the first and/or second circuit board contacts are physically joined to corresponding contacts on the one or more power consuming circuit boards.

8. The apparatus of claim 1, wherein the battery contacting arm, the first circuit board contacting arm, and the second circuit board contacting arm extend from a base.

9. The apparatus of claim 1, further comprising:

a spring integrally formed in or connected to the first circuit board contacting arm, the spring being configured to apply a mechanical contacting force between the first circuit board contacting arm and a corresponding contact on a power consuming circuit board.

10. The apparatus of claim 1, further comprising:

a spring integrally formed in or connected to the second circuit board contacting arm, the spring being configured to apply a mechanical contacting force between the second circuit board contacting arm and a corresponding contact on a power consuming circuit board.

11. The apparatus of claim 1, wherein:

two or more electrical conduits are arranged in a row;

the battery contacting arms of the two or more electrical conduits have a first center-to-center pitch; and the battery has contacts that have a second center-to-center pitch.

12. The apparatus of claim 11, wherein the first center-to-center pitch is larger than the second center-to-center pitch.

13. The apparatus of claim 1, further comprising:

a hook located at an end of the battery contacting arm; and a hook retaining piece located on the housing, wherein the hook restrains the end of the battery contacting arm from moving past the hook retaining piece.

14. A battery powered electronic device including an apparatus according to claim 1.

* * * * *